US011236762B2

(12) United States Patent
Jayarathne et al.

(10) Patent No.: US 11,236,762 B2
(45) Date of Patent: Feb. 1, 2022

(54) VARIABLE GEOMETRY OF A HOUSING FOR A BLOWER ASSEMBLY

(71) Applicant: Johnson Controls Technology Company, Auburn Hills, MI (US)

(72) Inventors: Madhuka M. Jayarathne, Wichita, KS (US); Hongdan Wang, Wuxi (CN); Roy R. Crawford, Blanchard, OK (US); Robert E. Cabrera, Wichita, KS (US); Paul J. Lucas, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 78 days.

(21) Appl. No.: 16/397,801

(22) Filed: Apr. 29, 2019

(65) Prior Publication Data

US 2020/0340494 A1 Oct. 29, 2020

Related U.S. Application Data

(60) Provisional application No. 62/839,388, filed on Apr. 26, 2019.

(51) Int. Cl.
*F04D 29/42* (2006.01)
*F04D 29/44* (2006.01)

(52) U.S. Cl.
CPC ..... *F04D 29/4233* (2013.01); *F04D 29/424* (2013.01); *F04D 29/4226* (2013.01); *F04D 29/441* (2013.01); *F05D 2240/14* (2013.01); *F05D 2250/51* (2013.01); *F05D 2250/52* (2013.01)

(58) Field of Classification Search
CPC ..... F04D 29/4233; F04D 29/424
See application file for complete search history.

(56) References Cited

U.S. PATENT DOCUMENTS 1,875,881 A * 9/1932 Morse ..... F04D 29/424 415/206
1,906,533 A * 5/1933 Burke ..... F24F 7/007 417/350
2,008,183 A * 7/1935 Mccord ..... A47K 10/48 392/381
2,279,425 A * 4/1942 Voysey ..... 415/146
2,405,190 A * 8/1946 Darling ..... 60/39.17
2,411,816 A * 11/1946 Teague, Jr. ..... 415/227
2,710,573 A * 6/1955 Marker ..... F24F 13/20 454/354
3,407,995 A * 10/1968 Kinsworthy ..... F04D 17/162 415/94

(Continued)

FOREIGN PATENT DOCUMENTS

GB 1400550 A * 7/1975 ..... F04D 29/4246

*Primary Examiner* — Woody A Lee, Jr.
*Assistant Examiner* — Brian Christopher Delrue
(74) *Attorney, Agent, or Firm* — Fletcher Yoder, P.C.

(57) ABSTRACT

A centrifugal blower has a first housing section and a second housing section separated by a width of the centrifugal blower. The centrifugal blower also has an intake port extending through the first housing section and the second housing section along the width, and an outlet port formed by the first housing section and the second housing section. A dimension of the width continuously decreases as the outlet port is approached along a length of the centrifugal blower.

15 Claims, 8 Drawing Sheets

(56) References Cited

U.S. PATENT DOCUMENTS 3,442,027 A * 5/1969 Hurwitz ..... B60S 3/002 34/571
3,750,286 A * 8/1973 Whelan ..... A01J 25/005 99/455
3,824,028 A * 7/1974 Zenkner ..... F04D 29/4226 415/58.6
3,856,431 A * 12/1974 Tucker ..... F04D 17/162 417/350
3,874,191 A * 4/1975 Hudson ..... F24F 13/20 62/426
D245,994 S * 10/1977 Olson ..... D23/383
4,635,382 A * 1/1987 Bourdeau ..... A45D 20/06 126/401
4,817,301 A * 4/1989 Belanger ..... B60S 3/002 15/316.1
4,851,019 A * 7/1989 Ahlf ..... A47L 9/1427 55/367
D306,602 S * 3/1990 Belanger ..... D15/144.1
5,141,397 A * 8/1992 Sullivan ..... F04D 29/4233 285/319
5,156,524 A * 10/1992 Forni ..... F04D 29/441 415/182.1
5,257,904 A * 11/1993 Sullivan ..... F04D 29/4233 403/11
5,281,092 A * 1/1994 Sullivan ..... F04D 29/626 415/206
5,403,163 A * 4/1995 Murphy ..... F16M 1/00 248/638
5,619,862 A * 4/1997 Ruger ..... B60H 1/00007 165/202
5,685,134 A * 11/1997 Thornburg ..... A01D 43/00 56/12.9
5,839,879 A * 11/1998 Kameoka ..... F04D 29/4233 415/206
6,200,093 B1 * 3/2001 Lee ..... F04D 29/422 415/204
6,386,828 B1 * 5/2002 Davis ..... A01K 1/0052 415/147
6,504,715 B2 * 1/2003 Ota ..... H05K 7/20581 165/104.33
6,588,228 B2 * 7/2003 Choi ..... F04D 29/4226 415/204
6,802,699 B2 * 10/2004 Mikami ..... F04D 29/4226 310/62
6,837,680 B2 * 1/2005 Kamiya ..... F01D 9/026 415/119
7,014,422 B2 * 3/2006 Hancock ..... F04D 29/4226 415/204
7,128,526 B2 * 10/2006 Paulsen ..... F04D 25/14 415/146
7,144,219 B2 * 12/2006 Hancock ..... F04D 29/422 415/212.1
D537,517 S * 2/2007 Hancock ..... D23/383
7,278,823 B2 10/2007 Platz
7,329,095 B2 * 2/2008 Wang ..... F04D 29/162 415/206
7,381,028 B2 * 6/2008 Hancock ..... F04D 17/02 415/214.1
7,417,856 B2 * 8/2008 Chiu ..... F04D 25/166 361/694
7,529,088 B2 * 5/2009 Chiu ..... F04D 29/161 361/695
7,591,633 B2 * 9/2009 Hancock ..... F04D 29/4226 415/206
7,677,237 B2 * 3/2010 Hancock ..... F24H 3/087 126/116 R
7,832,984 B2 * 11/2010 Harman ..... F04D 29/4233 415/204
8,011,114 B2 * 9/2011 Johnson ..... F04D 29/464 34/413
8,075,262 B2 12/2011 Watanabe et al.
8,397,401 B1 * 3/2013 Johnson ..... F04D 29/464 34/406
8,591,183 B2 * 11/2013 Lyons ..... F04D 29/4226 415/206
8,696,419 B2 * 4/2014 Liang ..... F04D 29/58 454/338
9,011,092 B2 * 4/2015 Eguchi ..... F04D 29/441 415/211.2
9,017,011 B2 * 4/2015 Gatley, Jr. ..... F04D 25/0653 415/98
9,017,893 B2 * 4/2015 DeWald ..... H01M 8/12 429/455
9,039,363 B2 * 5/2015 Hancock ..... F04D 29/424 415/206
D742,498 S * 11/2015 Zakula ..... D23/386
9,188,137 B2 * 11/2015 Hancock ..... F04D 29/422
D751,685 S * 3/2016 Wanezaki ..... D23/386
9,279,429 B2 * 3/2016 Hancock ..... F04D 29/4226
9,513,029 B2 * 12/2016 Post ..... F24H 3/087
2003/0091454 A1 * 5/2003 Raymond ..... F01C 21/0836 418/188
2004/0083747 A1 * 5/2004 Shichiken ..... B60H 1/00514 62/244
2005/0019155 A1 * 1/2005 Lasko ..... F04D 25/166 415/126
2005/0249587 A1 * 11/2005 Paulsen ..... F04D 25/14 415/146
2006/0051205 A1 * 3/2006 Platz ..... F04D 29/4233 415/206
2006/0057953 A1 * 3/2006 Natsume ..... F24F 13/12 454/161
2006/0257276 A1 * 11/2006 Lee ..... F04D 29/626 417/423.1
2006/0286924 A1 * 12/2006 Milana ..... F04D 25/0613 454/259
2007/0135779 A1 * 6/2007 Lalomia ..... A61M 1/005 604/319
2010/0326624 A1 * 12/2010 Hancock ..... F24F 3/044 165/47
2013/0260664 A1 * 10/2013 Morris ..... H05K 7/20172 454/184
2015/0328355 A1 * 11/2015 Rubin ..... B01D 46/0023 422/4
2016/0132027 A1 * 5/2016 Li ..... G05B 5/01 700/33
2016/0238027 A1 * 8/2016 Kang ..... F24F 1/0022
2017/0321907 A1 * 11/2017 Crawford ..... F24F 3/1405
2018/0031274 A1 * 2/2018 Wilson ..... F28D 1/0477
2020/0217328 A1 * 7/2020 Ray ..... F04D 29/403

* cited by examiner

VARIABLE GEOMETRY OF A HOUSING FOR A BLOWER ASSEMBLY

CROSS-REFERENCE TO RELATED APPLICATIONS

This application claims priority from and the benefit of U.S. Provisional Application Ser. No. 62/839,388, entitled "VARIABLE GEOMETRY OF A HOUSING FOR A BLOWER ASSEMBLY," filed Apr. 26, 2019, which is herein incorporated by reference in its entirety for all purposes.

BACKGROUND

The present disclosure relates generally to a heating, ventilation, and/or air conditioning (HVAC) system, and more particularly, to a variable geometry for a housing of a blower assembly of an HVAC system.

HVAC systems are utilized in residential, commercial, and industrial environments to control environmental properties, such as temperature and humidity, for occupants of the respective environments. The HVAC system may control the environmental properties through control of an airflow delivered to the environment. The HVAC system may include a blower that is configured to direct air across a heat exchanger in order to condition the air or otherwise exchange thermal energy with a refrigerant flowing within the heat exchanger. The blower may include a rotor disposed within a housing that draws in air from a surrounding environment and directs the air across the heat exchanger. It may be desirable to reduce an amount of power that HVAC blowers consume in order to reduce consumption of energy resources. Traditional blowers may not be configured to enable the HVAC system to efficiently achieve load demands under certain conditions. Additionally, larger blowers may be undesirable due to space constraints in current and/or future HVAC systems.

DRAWINGS

Figure 7:
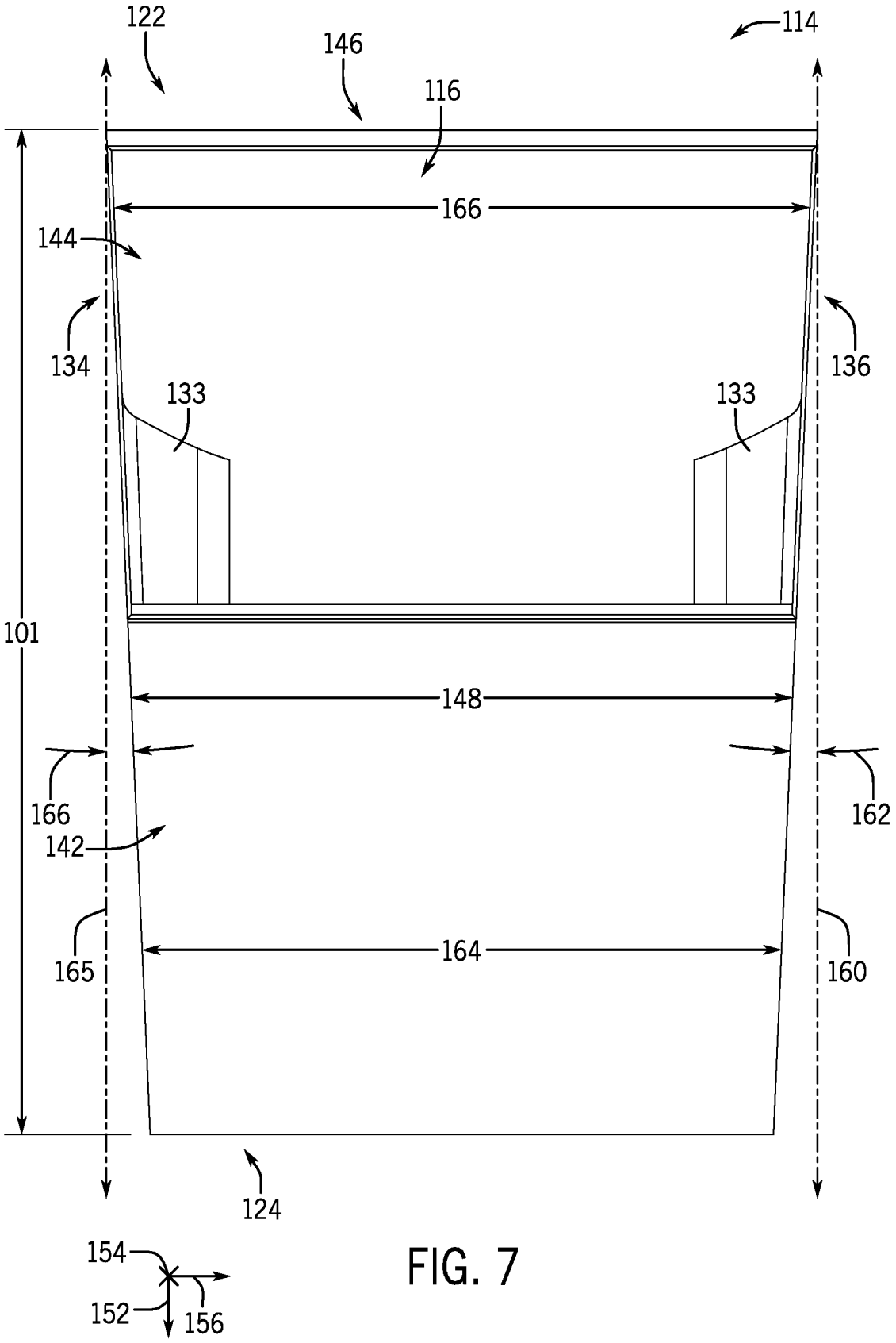
Figure 8:
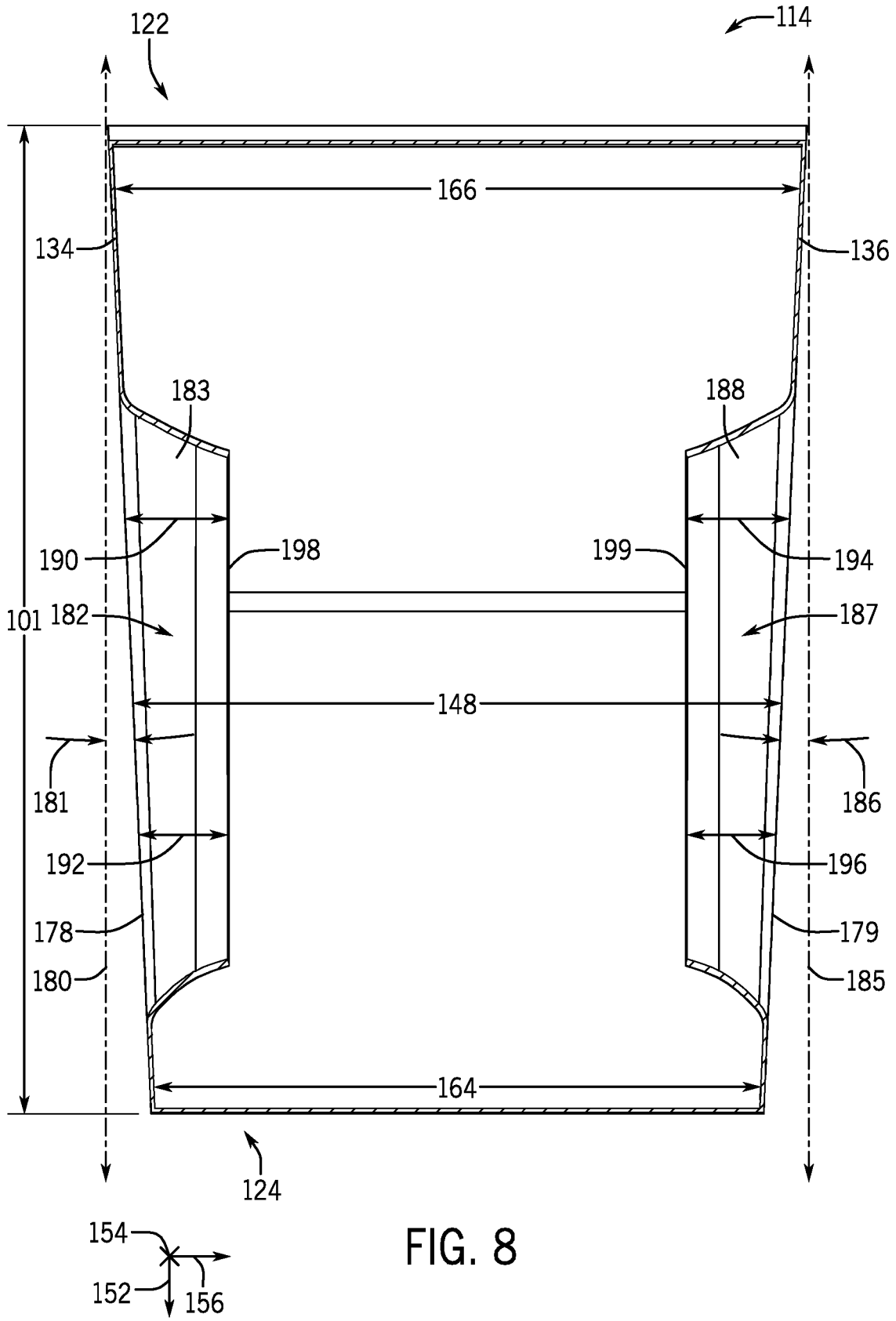

FIG. 7 is a top view of an embodiment of the housing of the blower assembly having the variable geometry along the longitudinal axis of the blower assembly, in accordance with an aspect of the present disclose; and FIG. 8 is a cross-section of an embodiment of the housing of the blower assembly, illustrating the variable geometry of venturi inlets of the blower assembly, in accordance with an aspect of the present disclosure.

SUMMARY

In one embodiment of the present disclosure, a centrifugal blower has a centrifugal fan that has a fan wheel. The fan wheel has a rotational axis and has blades extending radially outwardly from the fan wheel. The centrifugal blower also has a blower housing that has a first housing section and a second housing section disposed on opposite sides of the centrifugal fan and extending transverse to the rotational axis of the fan wheel, and a wall extending between the first housing section and the second housing section along the rotational axis of the fan wheel and defining a width of the blower housing. The centrifugal blower also has an intake passage that extends through the first housing section and facilitates fluid flow into the fan wheel, and an outlet of the housing that facilitates fluid flow out of the fan wheel and out of the housing. The outlet is formed by the first housing section, the second housing section, and the wall, and the outlet has an outer edge of the wall. The width of the blower housing decreases from the outer edge to an opposing portion of the wall along an axis transverse to the rotational axis.

In another embodiment of the present disclosure, a centrifugal blower has a first housing section and a second housing section separated by a width of the centrifugal blower. The centrifugal blower also has an intake port extending through the first housing section and the second housing section along the width, and an outlet port formed by the first housing section and the second housing section. A dimension of the width continuously decreases as the outlet port is approached along a length of the centrifugal blower.

In a further embodiment of the present disclosure, a heating, ventilation, and/or air conditioning (HVAC) system has a heat exchanger that has a plurality of tubes configured to flow a refrigerant therethrough, and a centrifugal blower that has a blower housing and a fan wheel having a rotational axis. The blower housing has a first housing section and a second housing section disposed on opposite sides of the fan wheel and extending transverse to the rotational axis of the fan wheel, a wall extending between the first housing section and the second housing section along the rotational axis and defining a width of the blower housing, and an outlet formed by the first housing section, the second housing section, and the wall. The outlet has an outer edge and the width of the blower housing decreases from the outer edge to an opposing portion of the wall along an axis transverse to the rotational axis. Rotation of the fan wheel is configured to direct an airflow through the outlet and across the plurality of tubes of the heat exchanger to place the airflow in thermal communication with the refrigerant.

Other features and advantages of the present application will be apparent from the following, more detailed description of the embodiments, taken in conjunction with the accompanying drawings which illustrate, by way of example, the principles of the application.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

The present disclosure is directed to an improved housing of a blower assembly that may increase an efficiency of a heating, ventilation, and/or air conditioning (HVAC) system. As mentioned above, it may be desirable to reduce an amount of power that HVAC blowers consume in order to decrease consumption of natural resources used to provide such power. Additionally, larger blower assemblies may be undesirable due to space constraints in current and/or future HVAC systems. As such, embodiments of the present disclosure are directed to an improved housing of a blower assembly, such as a centrifugal blower, that facilitates expansion of an airflow discharged from a rotor of the blower assembly. Specifically, the housing of the blower assembly expands the airflow as the airflow is directed through a chamber within the housing and toward the outlet of the blower assembly. As a result, the blower assembly may experience an increase in the velocity of the airflow directed through the blower assembly, as well as a reduction in power consumption used to achieve the increased velocity. For example, the housing of the blower assembly may include a first housing section, or a first housing panel, and a second housing section, or a second housing panel, separated by a wall of the blower assembly. A portion of the blower assembly defined by the wall, the first housing section, and the second housing section may define the chamber through which the airflow is directed toward the outlet of the blower assembly. The wall between the first housing section and the second housing section continuously decreases in length from a first side of the blower assembly to a second side of the blower assembly. As referred to herein, the first side of the blower assembly is a first end of a cross-section of the housing that is proximate to the outlet of the blower assembly, and the second side of the blower assembly is a second end of the cross-section of the housing, opposite the first end.

As the length of the wall decreases between the first housing section and the second housing section, the volume, or a radial dimension, of the chamber also proportionally decreases from the outlet of the blower assembly to the rotor of the blower assembly. As such, the volume of the chamber within the housing of the blower assembly increases from the rotor of the blower assembly to the outlet of the housing, thereby facilitating the expansion of the airflow as the airflow is directed through the chamber toward the outlet of the blower assembly. In this way, an amount of static pressure associated with the airflow that is converted to dynamic pressure is increased as compared to a blower assembly with a constant width between the first housing section and the second housing section. Because an increased amount of the static pressure is converted to dynamic pressure, less energy is used to drive the airflow from the chamber, through the outlet of the blower assembly, and across a heat exchanger, thereby increasing a power efficiency of the blower assembly and the HVAC system.

Figure 1:
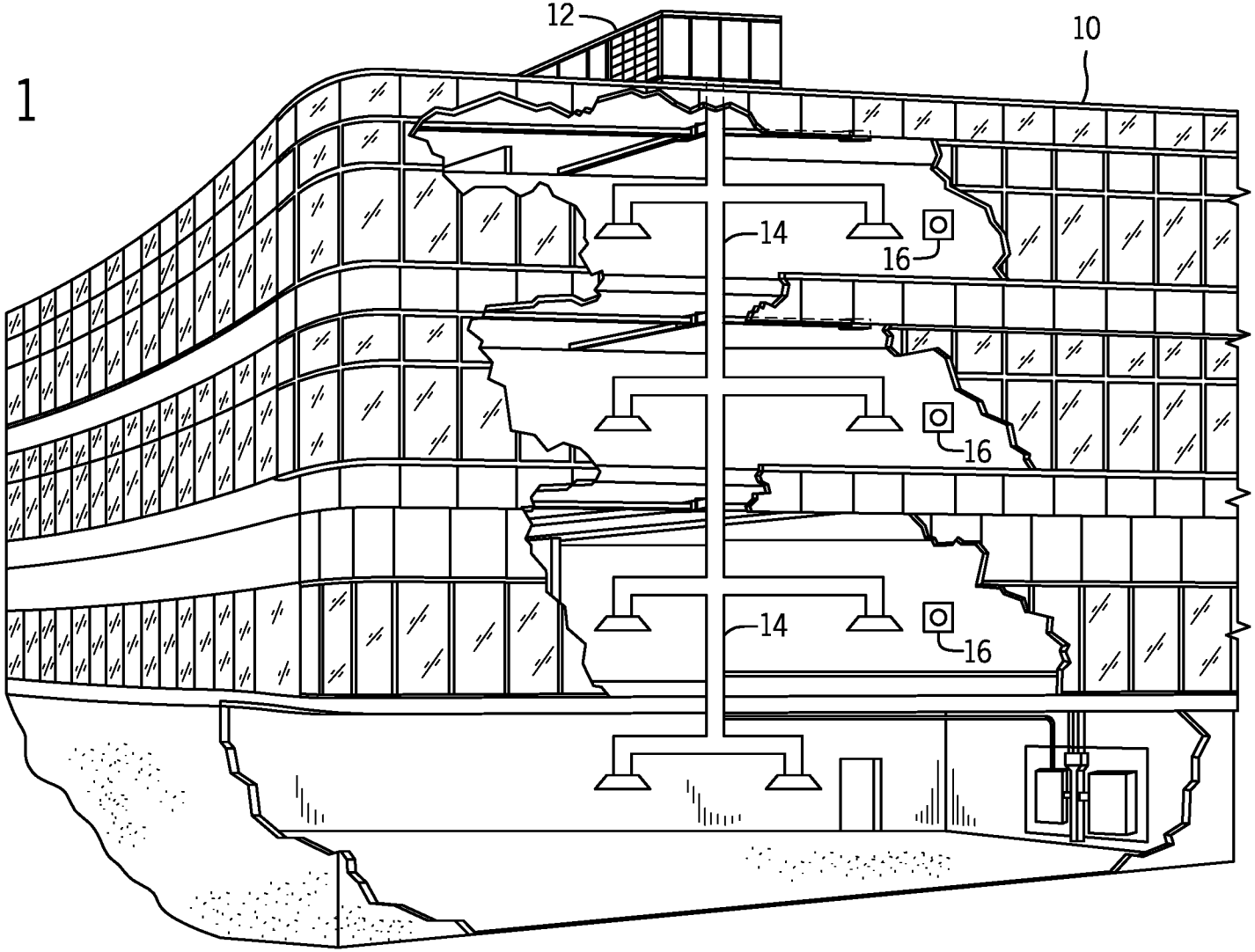
FIG. 1 is a schematic of an embodiment of an HVAC system for building environmental management that includes an HVAC unit, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
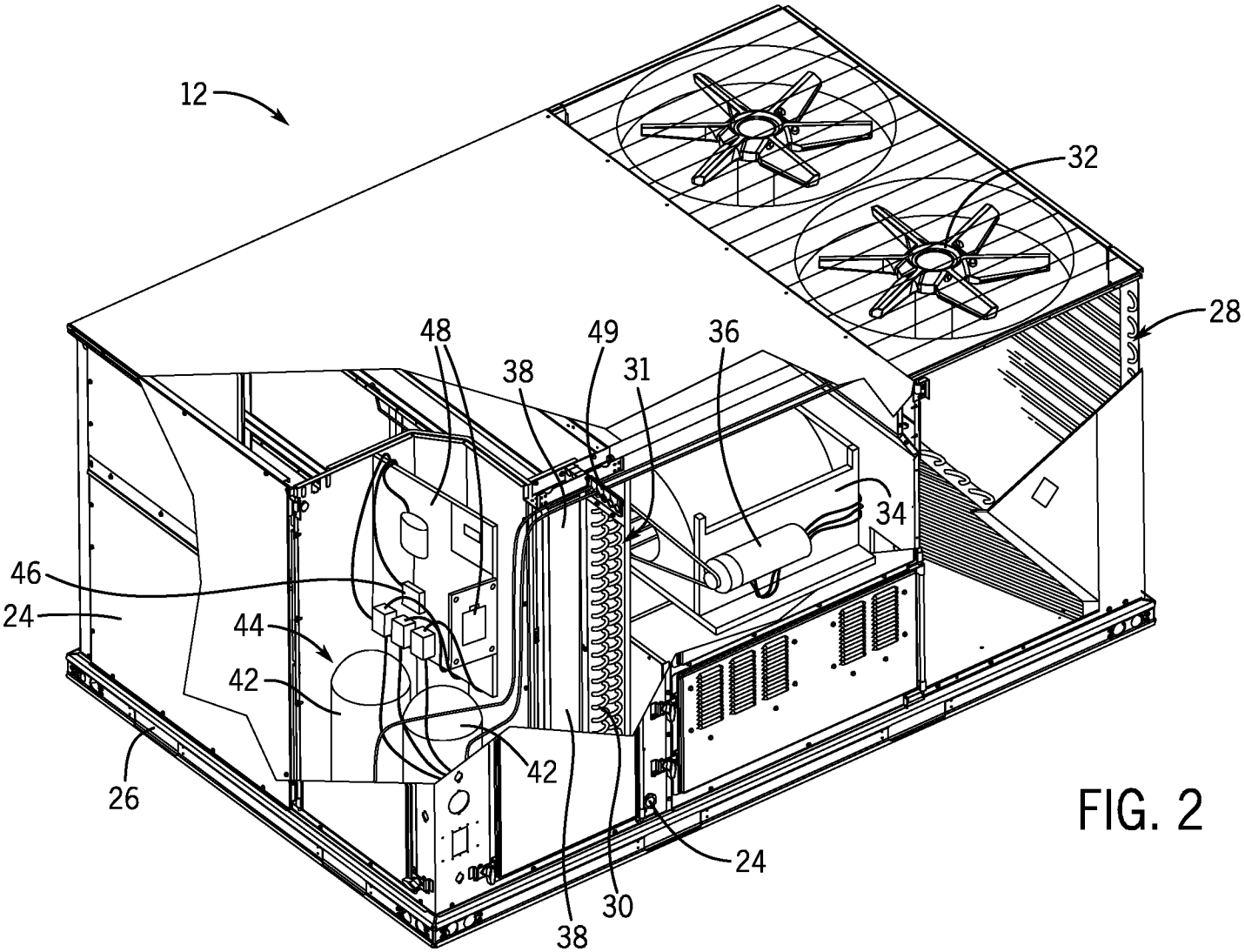
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
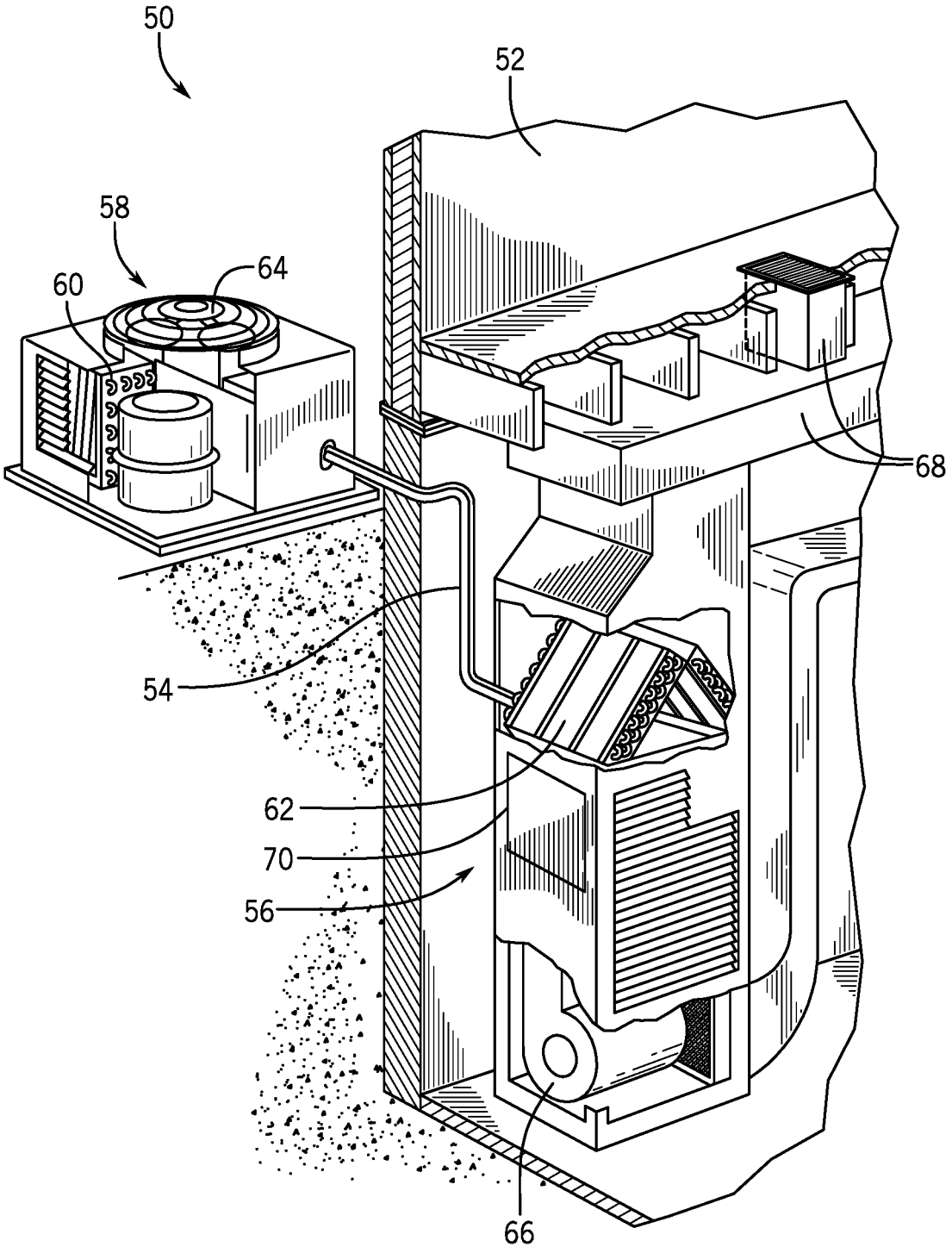
FIG. 3 is a cutaway, perspective view of an embodiment of a split, residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
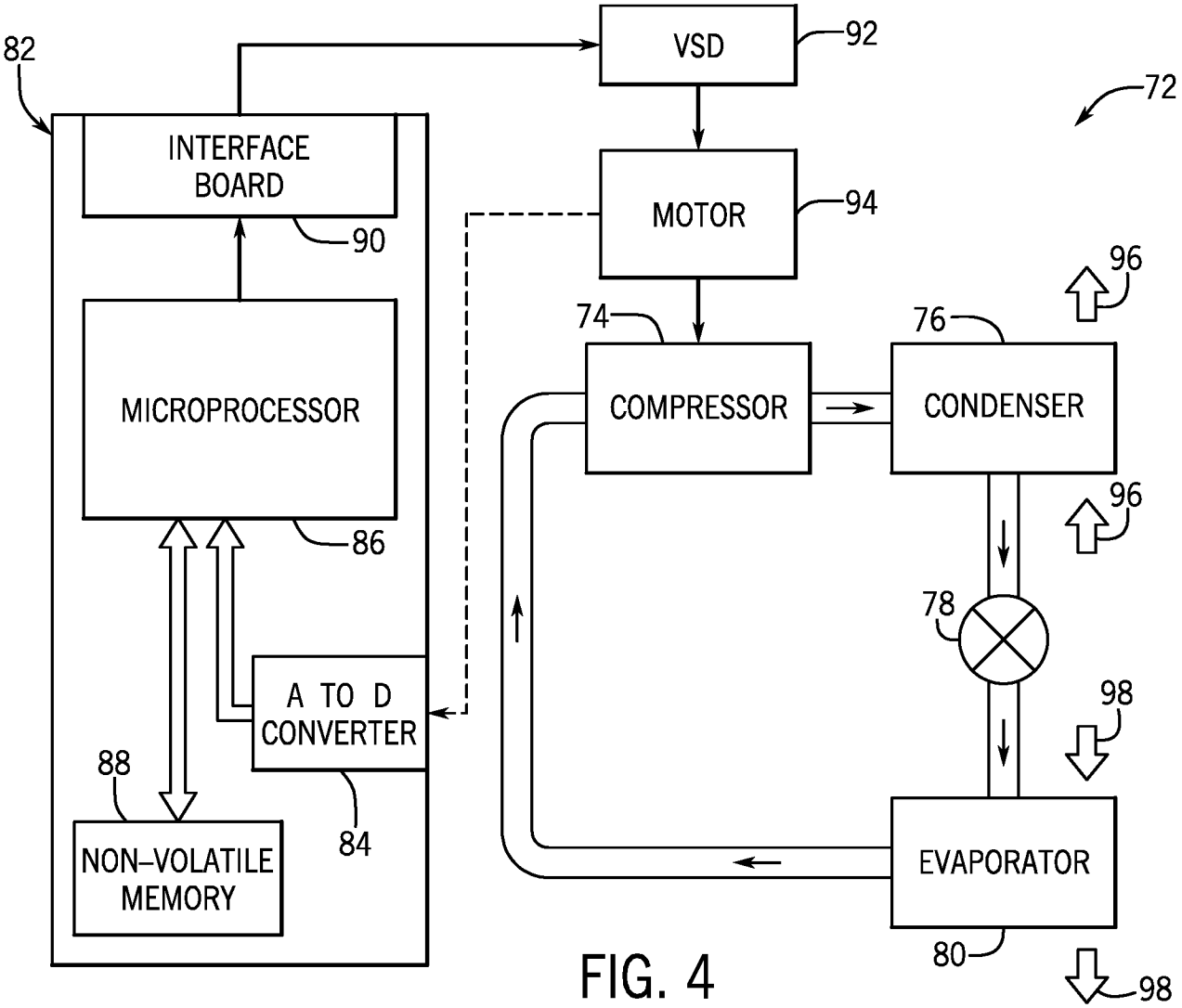
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to an improved housing of a blower assembly, such as a centrifugal blower, having a wall with a length that continuously decreases from a first side of the blower assembly to a second side of the blower assembly. As used herein, the first side of the blower assembly refers to a first end of a cross section of the housing that is proximate to the outlet of the blower assembly, and the second side of the blower assembly refers to a second end of the cross section of the housing, opposite the first end. For example, a length of the blower assembly may extend between the first end of the cross section of the housing and the second end of the cross section of the housing. In some embodiments, the wall of the blower assembly may form a two-degree angle relative to a longitudinal axis of the blower assembly. However, in other embodiments, the length of the wall of the blower assembly may form a one-degree angle, a three-degree angle, a five-degree angle, a ten-degree angle, a twenty-degree angle, a thirty-degree angle, or any other suitable angle relative to the longitudinal axis of the blower assembly to facilitate expansion of the airflow discharged from the rotor of the blower assembly and directed toward the outlet of the blower assembly.

For example, the housing of the blower assembly may include a first housing section and a second housing section disposed on opposite sides of the rotor and separated by the wall of the blower assembly. The length of the wall between the first housing section and the second housing section continuously decreases from the first side of the blower assembly to the second side of the blower assembly, thereby forming an angle with the longitudinal axis of the blower assembly. The first housing section and the second housing section may include one or more openings, or intake passages, that facilitate drawing air from a surrounding environment into the housing of the blower assembly. Rotation of the rotor within the housing may discharge an airflow from a chamber within the housing and may direct the airflow toward the outlet of the blower assembly. The chamber may be defined by the wall of the blower assembly, the first housing section, and the second housing section. Additionally, the volume of the chamber may decrease proportionally with the length of the wall of the blower assembly from the first end of the blower assembly to the second end of the blower assembly.

As the airflow is driven through the chamber toward the outlet of the blower assembly via rotation of the rotor, the airflow expands within the chamber as the chamber increases in volume from the first side of the blower assembly to the second side of the blower assembly. That is, since the length of the wall of the blower assembly continuously increases from the second side of the blower assembly to the first side of the blower assembly, the increasing volume of the chamber facilitates the gradual expansion of the airflow as the airflow is driven toward the outlet of the blower assembly. As the airflow expands within the chamber, an increased amount static pressure of the airflow is converted to dynamic pressure within the blower assembly, as compared to the static pressure of the airflow within a blower assembly having a wall with a constant length between the first side of the blower assembly and the second side of the blower assembly. Since the airflow has a relatively lower amount of static pressure and a relatively higher amount of dynamic pressure, less energy is utilized to drive the airflow through the outlet of the blower assembly by virtue of an increased pressure differential that causes the airflow to be directed toward a heat exchanger of an HVAC system, such as the HVAC unit 12 and/or the residential heating and cooling system 50. As such, the variable geometry of the housing of the blower assembly may increase a power efficiency of the blower assembly and the HVAC system.

Figure 5:
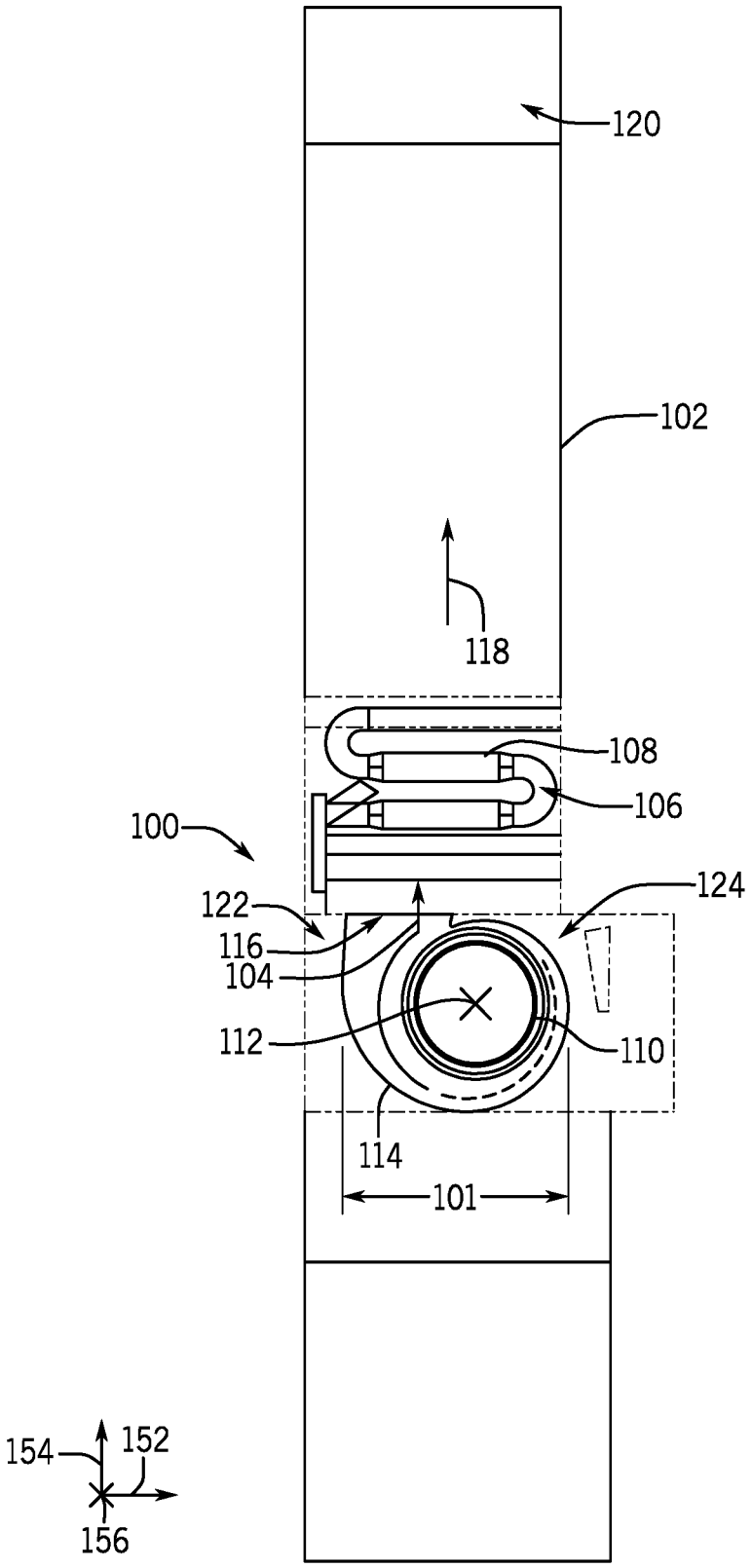
FIG. 5 is a side view schematic of an embodiment of a blower assembly and a heat exchanger disposed within ductwork of a structure, in accordance with an aspect of the present disclosure.

To facilitate discussion of FIGS. 5-8, a blower assembly 100 and its components are described with reference to a longitudinal axis or direction 152, a vertical axis or direction 154, and a lateral axis or direction 156. With the foregoing in mind, FIG. 5 is an elevation view of an embodiment of the blower assembly 100, such as the blower assembly 34, which is disposed within a duct assembly 102, such as the ductwork 14, and is configured to direct an airflow 104 across a heat exchanger 106. The heat exchanger 106 conditions the airflow 104 by placing the airflow 104 in thermal communication with a refrigerant flowing through tubes 108 of the heat exchanger 106. The blower assembly 100 includes a rotor 110, such as a centrifugal fan having a fan wheel, that is configured to rotate about a rotational axis 112 extending through a housing 114 of the blower assembly 100. For example, the rotational axis 112 of the rotor 110 may extend in the lateral direction 156. As the rotor 110 rotates about the rotational axis 112, blades that extend outwardly from the rotor 110 draw air into one or more intake passages of the housing 114 of the blower assembly 100 and increase a velocity of the air to generate the airflow 104. The rotation of the rotor 110 directs the airflow 104 through a chamber in the housing 114 of the blower assembly 100 and through an outlet 116 of the housing 114 toward the heat exchanger 106. After exchanging thermal energy with the refrigerant in the heat exchanger 106, a conditioned airflow 118 is directed toward an outlet 120 of the duct assembly 102 to condition an environment within a structure, such as the building 10.

As set forth above, the blower assembly 100 may include an improved configuration of the housing 114 having a first housing section and a second housing section disposed on opposite sides of the rotor 110 and separated by a wall of the blower assembly 100. The distance between the first housing section and the second housing section, or a length of the wall, continuously decreases from a first side 122 of the blower assembly 100 to a second side 124 of the blower assembly 100. That is, the distance between the first housing section and the second housing section continuously decreases along a length 101 of the blower assembly 100 extending from the first side 122 of the blower assembly 100 to the second side 124 of the blower assembly 100. As such, the first housing section and the second housing section form an angle relative to a longitudinal axis of the blower assembly 100. As the airflow 104 is discharged from the rotor 110 and directed through the outlet 116 of the housing 114, the geometry of the housing 114 of the blower assembly 100 facilitates expansion of the airflow 104 within a chamber of the blower assembly 100. Accordingly, the velocity of the airflow 104 is increased and an efficiency, such as a power efficiency, of the blower assembly 100 and the HVAC system also increases.

Figure 6:
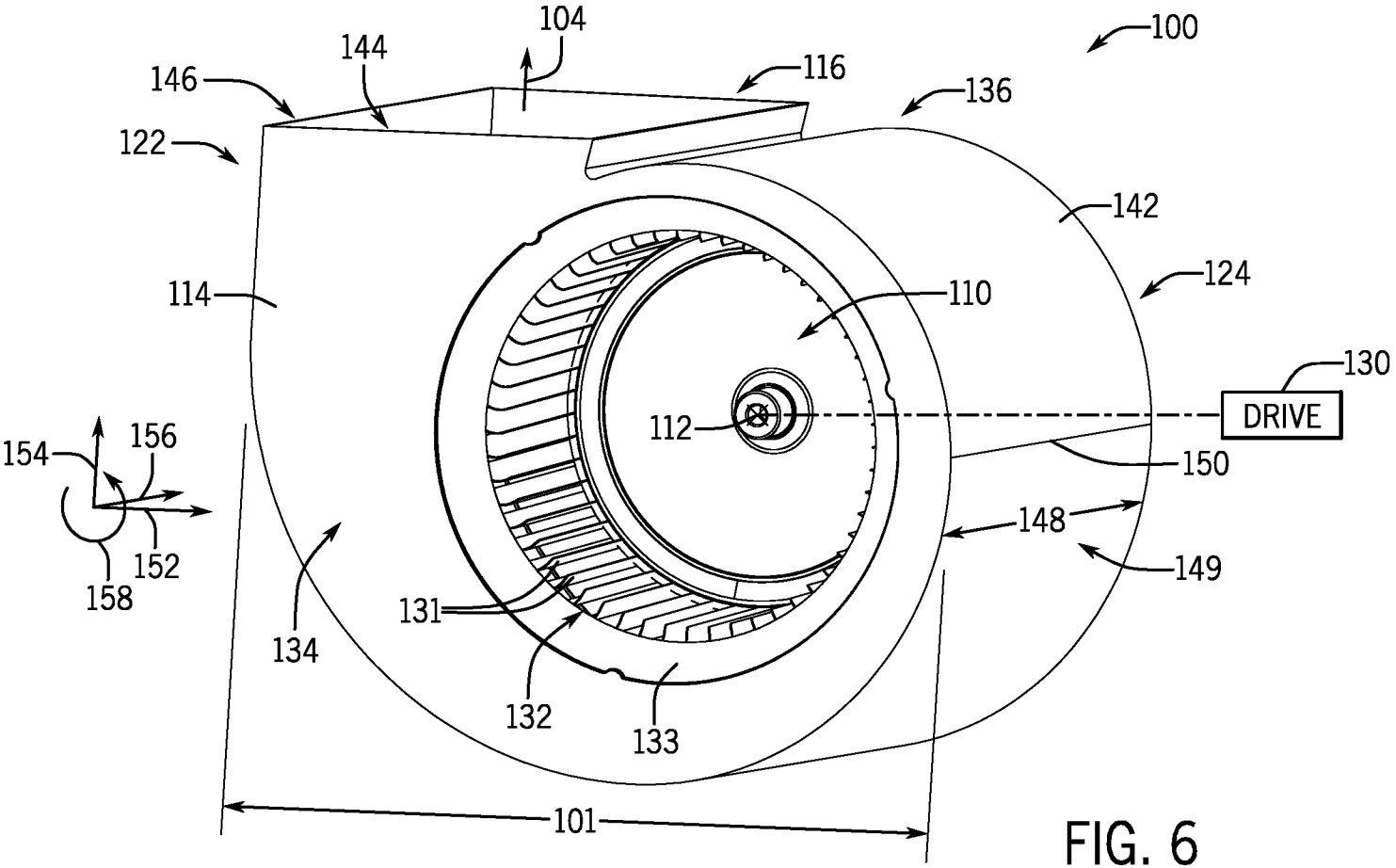
FIG. 6 is a perspective view of an embodiment of a housing of the blower assembly having a variable geometry along a longitudinal axis of the blower assembly, in accordance with an aspect of the present disclosure.

FIG. 6 is a perspective view of an embodiment of the blower assembly 100. As shown in the illustrated embodiment of FIG. 6, the blower assembly 100 includes the rotor 110 disposed between a first housing section 134 of the blower assembly 100 and a second housing section 136 of the blower assembly 100. The rotor 110 is configured to rotate about the rotational axis 112. For example, the rotational axis 112 may extend in the lateral direction 156. In some embodiments, the blower assembly 100 includes a drive 130, such as the motor 36, which rotates the rotor 110 about the rotational axis 112. As the rotor 110 rotates about the rotational axis 112, blades 131 of the rotor 110 may draw air into the housing 114 of the blower assembly 100 via an intake passage 132 in the first housing section 134 of the blower assembly 100. In some embodiments, the intake passage 132 is positioned eccentrically along the length 101 of the blower assembly 100 extending between the first side 122 and the second side 124 of the blower assembly 100. Although the illustrated embodiment of FIG. 6 depicts a single intake passage 132 in the first housing section 134, it should be understood that the blower assembly 100 may include an additional intake passage in the second housing section 136 of the blower assembly 100. In some embodiments, the intake passage 132 may include a curved wall 133 having a venturi profile, which may facilitate drawing the air into the housing 114 of the blower assembly 100. For example, the air may generally flow along, or adhere to, the curved wall 133, which may direct the air into the housing 114. In any case, as air is drawn into the housing 114 of the blower assembly 100, the rotation of the rotor 110 about the rotational axis 112 increases the velocity of the air entering the blower assembly 100. The airflow 104 is then directed through a chamber 144 in the housing 114 and, ultimately, toward the heat exchanger 106, such as the heat exchanger 30, via the outlet 116 of the blower assembly 100.

As noted above, the housing 114 of the blower assembly 100 includes the first housing section 134 and the second housing section 136 disposed on opposite sides of the rotor 110 of the blower assembly 100. The first housing section 134 and the second housing section 136 extend transversely to the rotational axis 112 about which the rotor 110 rotates. For example, the first housing section 134 and the second housing section 136 extend in the longitudinal direction 152 and/or the vertical direction 154. Additionally, the housing 114 of the blower assembly 100 includes a wall 142 that extends between the first housing section 134 and the second housing section 136 in the lateral direction 156. In one embodiment, the wall 142 may be formed as a single panel or a curvilinear panel. In some embodiments, the housing 114 having the first housing section 134, the second housing section 136, and the wall 142 is formed from sheet metal or another suitable metallic material. In other embodiments, the housing 114 having the first housing section 134, the second housing section 136, and the wall 142 may include a polymeric material or another suitable material. The first housing section 134, the second housing section 136, and the wall 142 form the chamber 144 within the housing 114 that terminates at the outlet 116 of the housing 114. In some embodiments, the wall 142 has an outer edge 146 at the outlet 116, and the outer edge 146 extends from the outlet 116 between the first housing section 134 and the second housing section 136, around the rotor 110, and about the rotational axis 112 to form a semi-circular cross-sectional geometry of the housing 114. The chamber 144 of the housing 114 facilitates an increase in velocity of the air within the chamber 144, such that the airflow 104 emitted from the outlet 116 achieves a desired flow rate and/or a desired rate or amount of thermal communication with the heat exchanger 106.

As described above, the first housing section 134 and the second housing section 136 are separated in the lateral direction 156 by a distance 148, which may define a width of the blower assembly 100. The distance 148 of the blower assembly 100 continuously decreases from the first side 122 of the blower assembly 100 to the second side 124 of the blower assembly 100. As illustrated in FIG. 6, the distance 148 of the blower assembly 100 corresponds to a length 149 of the wall 142, which decreases as the wall 142 extends in a counter-clockwise direction 158 around the rotor 110 and about the rotational axis 112. In some embodiments, the length 149 of the wall 142 may stop decreasing at a transition portion 150 of the wall 142. For example, the length 149 of the wall 142 may decrease from the outer edge 146 of the wall 142 on the first side 122 to the transition portion 150 on the second side 124, and the length 149 of the wall 142 may be constant as the wall extends past the transition portion 150 toward the outlet 116 in a counter-clockwise direction 158 around the rotor 110 and about the rotational axis 112. In another example, the length 149 of the wall 142 may decrease from the outer edge 146 on the first side 122 to the transition portion 150 on the second side 124, and the length 149 of the wall 142 may increase as the wall 148 extends past the transition portion 150 toward the outlet 116 in a counter-clockwise direction 158 around the rotor 110 and about the rotational axis 112.

As the distance 148 between the first housing section 134 and the second housing section 136 of the blower assembly 100 decreases from the first end 122 of the blower assembly 100 to the second end 124 of the blower assembly 100, the volume of the chamber 144 within the housing 114 decreases proportionally with the distance 148. That is, as the distance 148 between the first housing section 134 and the second housing section 136 of the blower assembly 100 decreases along the length 101 of the blower assembly, the volume of the chamber 144 decreases proportionally with the distance 148. As such, the chamber 144 increases in volume from the second end 124 of the blower assembly 100 to the first end 122 of the blower assembly, such that the airflow 104 discharged from the rotor 110 may expand within the chamber 144 as the airflow 104 is directed toward the outlet 116 of the housing 114. In this way, an increased amount of static pressure associated with the airflow 104 is converted to dynamic pressure within the chamber 144 of the blower assembly 100, as compared to a blower assembly having a housing with a constant width. Since the airflow 104 has a relatively lower amount of static pressure and relatively higher amount of dynamic pressure, less energy is utilized to drive the airflow 104 through the chamber 144 of the blower assembly 100 due to a pressure differential created within the chamber 144. As such, less power may be utilized to ultimately direct the airflow 104 toward the heat exchanger 106 via the outlet 116 of the blower assembly 100, thereby increasing a power efficiency of the blower assembly 100 and the HVAC system.

FIG. 7 is a top view of an embodiment of the housing 114 of the blower assembly 100, illustrating the variable distance 148 between the first housing section 134 and the second housing section 136 from the first end 122 of the blower assembly 100 to the second end 124 of the blower assembly 100. As shown in the illustrated embodiment of FIG. 7, a length 166 of the wall 142 proximate to the first end 122 of the housing 100 is greater than a length 164 of the wall 142 proximate to the second end 124 of the housing 114. That is, the distance 148 between the first housing section 134 and the second housing section 136 decreases from the first end 122 to the second end 124, thereby forming a first angle 162 between the second housing section 136 and a first longitudinal axis 160 of the housing 114 and a second angle 166 between the first housing section 134 and a second longitudinal axis 165 of the housing 114. In some embodiments, the first angle 162 and/or the second angle 166 between the second housing section 136 and the longitudinal axis 160 may be approximately two degrees. In other embodiments, the first angle 162 and/or the second angle 166 may be one degree, three degrees, five degrees, ten degrees, twenty degrees, thirty degrees, or any other suitable angle to facilitate expansion of the airflow 104 through the chamber 144 of the blower assembly 100. For example, since the chamber 144 increases in volume from the second end 124 of the blower assembly 100 to the first end 122 of the blower assembly in the circumferential direction 158, the airflow 104 may expand within the chamber 144 as the airflow 104 is directed to the outlet 116 of the housing 114. In this way, an increased amount of static pressure associated with the airflow 104 is converted to dynamic pressure within the chamber 144 of the blower assembly 100, as compared to a blower assembly having a housing with a constant width. Since the airflow 104 has a relatively lower amount of static pressure and a relatively higher amount of dynamic pressure, less energy is utilized to drive the airflow 104 through the chamber 144 of the blower assembly 100 as a result of an increased pressure differential generated between the chamber 144 and the outlet 116 of the blower assembly 100. Accordingly, an amount of power utilized to ultimately direct the airflow 104 toward the heat exchanger 106 via the outlet 116 of the blower assembly 100 is reduced, thereby increasing a power efficiency of the blower assembly 100 and the HVAC system.

As shown in the illustrated embodiment of FIG. 7, the distance 148 between the first housing section 134 and the second housing section 136 decreases along the longitudinal direction 152. For example, the first housing section 134 forms the second angle 166 with respect to the second longitudinal axis 165 of the housing 114, and the second housing section 136 forms the first angle 162 with respect to the first longitudinal axis 160 of the housing 114. In some embodiments, the first angle 162 and the second angle 166 may be substantially equivalent. In other embodiments, the first angle 162 and the second angle 166 may be different. For example, the first angle 162 may be greater than the second angle 166, or the first angle 162 may be less than the second angle 166. In still further embodiments, the first housing section 134 or the second housing section 136 may extend substantially parallel to the first longitudinal axis 160 or the second longitudinal axis 165, respectively, while the other housing section 134, 136 extends at the angle 162, 166 with respect to the longitudinal axis 165, 166 of the housing 144. That is, the distance 148 between the first housing section 134 and the second housing section 136 may decrease inwardly based on the angle 162, 166 of one of the respective housing sections 134, 136 because the other housing section 134, 136 is substantially parallel to the longitudinal axis 160, 165 and/or the longitudinal direction 152.

FIG. 8 is a cross-sectional view of an embodiment of the housing 114 of the blower assembly 100, illustrating a first intake passage 182, such as the intake passage 132, having a first curved wall 183, such as the curved wall 133, and a second intake passage 187 having a second curved wall 188. The curved walls 183, 188 of the intake passages 182, 187 facilitate drawing air into the housing 114 of the blower assembly 100. For example, the curved walls 183, 188 may have a venturi profile that extends from the first housing section 134 and the second housing section 136, respectively, toward the chamber 144 of the housing 114 and terminates at a respective inner edge 198, 199 within the chamber 144. As described above, the length 166 of the wall 142 proximate to the first end 122 of the housing 100 is greater than the length 164 of the wall 142 proximate to the second end 124 of the housing 114. As illustrated in the embodiment of FIG. 8, a length 190 of the first curved wall 183 proximate to the first end 122 of the housing 114 is greater than a length 192 of the first curved wall 183 proximate to the second end 124 of the housing 114. Similarly, a length 194 of the second curved wall 188 proximate to the first end 122 of the housing 114 is greater than a length 196 of the second curved wall 188 proximate to the second end 124 of the housing 114. That is, the length of the first curved wall 183 and the length of the second curved wall 188 decrease along the longitudinal axis 152. In some embodiments, the curved walls 183, 188 form respective angles 181, 186 relative to respective longitudinal axes 180, 185 of the housing 114. In some embodiments, the angles 181, 186 may be approximately two-and-a-half degrees. In other embodiments, the angles 181, 186 may be approximately one degree, one-and-a-half degrees, two degrees, three degrees, five degrees, and/or any other suitable angle to facilitate drawing air into the housing 114 of the blower assembly 100.

As shown in the illustrated embodiment of FIG. 8, the length of each curved wall 183, 188 decreases at substantially the same rate as the distance 148 between the first housing section 134 and the second housing section 136, such that outer edges 178, 179 of each curved wall 183, 188 is substantially aligned with, or substantially parallel to, the respective housing section 134, 136. For example, the length of each curved wall 183, 188 decreases as the distance 148 between the first housing section 134 and the second housing section 136 decreases. Each curved wall 183, 188 terminates at the respective inner edges 198, 199, which may be substantially parallel to each other and the longitudinal axes 180, 185 of the housing 114.

As set forth above, embodiments of the present disclosure may provide one or more technical effects useful in increasing an efficiency of an HVAC system. For example, embodiments of the present disclosure are directed to an improved housing of a blower assembly that facilitates expansion of an airflow within a chamber of the housing of the blower assembly. For example, the distance between a first housing section of the blower assembly and a second housing section of the blower assembly may continuously decrease from a first side of the blower assembly to a second side of the blower assembly. As the distance decreases between the first housing section and the second housing section, the volume of the chamber within the housing of the blower assembly proportionally decreases from the outlet of the blower assembly at the first side to the second side of the blower assembly. As such, the volume of the chamber increases as the airflow moves toward an outlet of the housing, thereby facilitating the expansion of the airflow directed from the chamber toward the outlet of the blower assembly. In this way, an increased amount of static pressure associated with the airflow is converted to dynamic pressure as compared to a blower assembly having a constant distance between the first housing section and the second housing section. Because an increased amount of static pressure is converted to dynamic pressure, less energy is utilized to drive the airflow through the outlet of the blower assembly as a result of an increased pressure differential established between the chamber and the outlet. As such, a reduced amount of power may be utilized to direct the airflow across a heat exchanger, thereby increasing the power efficiency of the blower assembly and the HVAC system.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A centrifugal blower, comprising:

a centrifugal fan including a fan wheel, wherein the fan wheel has a rotational axis, and including blades extending radially outwardly from the fan wheel;

a blower housing including a first housing section and a second housing section disposed on opposite sides of the centrifugal fan and extending transverse to the rotational axis of the fan wheel, and further including a wall extending between the first housing section and the second housing section along the rotational axis;

a curved wall extending from the first housing section and having a venturi profile, wherein the curved wall forms an intake passage extending through the first housing section and facilitating fluid flow into the fan wheel, wherein the curved wall includes an inner circumferential edge defining a distal end of the intake passage; and an outlet of the blower housing configured to facilitate fluid flow out of the fan wheel and out of the blower housing, wherein the outlet is formed by the first housing section, the second housing section, an outer edge of the wall, and an additional edge of the wall, wherein the first housing section, the second housing section, and the wall form an interior volume of the blower housing, wherein a width of the interior volume extends between the first housing section and the second housing section along the rotational axis, wherein the width of the interior volume decreases from the outer edge to an opposing portion of the wall along an axis transverse to the rotational axis, wherein an additional width of the outlet between the first housing section and the second housing section decreases from the outer edge to the additional edge along the axis, wherein the centrifugal fan is disposed entirely within the interior volume, and wherein at least a portion of the inner circumferential edge is positioned between the outer edge and the additional edge along the axis.

2. The centrifugal blower of claim 1, wherein the width of the interior volume of the blower housing continuously decreases from the outer edge to the opposing portion of the wall along a portion of a circumference of the wall as the circumference extends toward the opposing portion of the wall.

3. The centrifugal blower of claim 1, wherein the first housing section forms an oblique angle relative to the axis transverse to the rotational axis.

4. The centrifugal blower of claim 3, wherein the oblique angle is less than three degrees.

5. The centrifugal blower of claim 1, wherein a width dimension of the curved wall decreases along the axis transverse to the rotational axis.

6. The centrifugal blower of claim 1, wherein the first housing section forms a first oblique angle relative to the axis transverse to the rotational axis, wherein the second housing section forms a second oblique angle relative to the axis transverse to the rotational axis, and wherein the first oblique angle and the second oblique are different from one another.

7. A centrifugal blower, comprising:

a centrifugal fan including a fan wheel configured to rotate about a rotational axis;

a blower housing comprising a first housing section, a second housing section, and a wall extending between the first housing section and the second housing section, wherein the first housing section, the second housing section, and the wall form an interior volume of the blower housing, and wherein a width of the interior volume extends between the first housing section and the second housing section along the rotational axis;

a curved wall extending from the first housing section and having a venturi profile, wherein the curved wall forms an intake port extending through the first housing section and along the width, wherein the curved wall includes an inner circumferential edge defining a distal end of the intake port; and an outlet port formed by the first housing section, the second housing section, an outer edge of the wall, and an additional edge of the wall, wherein the outlet port has a trapezoidal cross-sectional profile, wherein the width of the interior volume of the blower housing decreases from the outer edge to an opposing portion of the wall along an axis transverse to the rotational axis, the centrifugal fan is disposed entirely within the interior volume, and at least a portion of the inner circumferential edge is positioned between the outer edge and the additional edge along the axis.

8. The centrifugal blower of claim 7, wherein the intake port is eccentrically positioned along a length of the centrifugal blower.

9. The centrifugal blower of claim 7, wherein the wall is a curvilinear panel extending partially about the first housing section and the second housing section, wherein the outlet port is bound by the additional edge of the wall such that opposing ends of the curvilinear panel terminate at the outlet port.

10. The centrifugal blower of claim 9, wherein an additional width of the curvilinear panel is defined by the width of the interior volume of the centrifugal blower, and the additional width of the curvilinear panel continuously decreases along a length of the centrifugal blower.

11. The centrifugal blower of claim 10, wherein the opposing ends of the curvilinear panel comprise a first end and a second end, wherein the additional width of the curvilinear panel continuously decreases along the length of the centrifugal blower from the first end to a transition portion of the curvilinear panel and the additional width of the curvilinear panel is constant along the length of the centrifugal blower from the transition portion to the second end, wherein the outlet port is positioned at a first end portion of the centrifugal blower, and the transition portion is positioned at a second end portion of the centrifugal blower, opposite to the first end portion.

12. The centrifugal blower of claim 10, wherein the opposing ends of the curvilinear panel comprise a first end and a second end, wherein the additional width of the curvilinear panel continuously decreases along the length of the centrifugal blower from the first end to a transition portion of the curvilinear panel and the additional width of the curvilinear panel increases along the length of the centrifugal blower from the transition portion to the second end.

13. A heating, ventilation, and/or air conditioning (HVAC) system, comprising:

a heat exchanger having a plurality of tubes configured to flow a refrigerant therethrough; and a centrifugal blower having a blower housing and a fan wheel having a rotational axis, wherein the blower housing includes:

a first housing section and a second housing section disposed on opposite sides of the fan wheel and extending transverse to the rotational axis of the fan wheel;

a wall extending between the first housing section and the second housing section along the rotational axis;

a curved wall extending from the first housing section and having a venturi profile, wherein the curved wall forms an intake passage extending through the first housing section to facilitate flow of an airflow into the blower housing, wherein the curved wall includes an inner circumferential edge defining a distal end of the intake passage; and an outlet formed by the first housing section, the second housing section, an outer edge of the wall, and an additional edge of the wall, wherein the first housing section, the second housing section, and the wall form an interior volume of the blower housing, wherein a width of the interior volume extends between the first housing section and the second housing section along the rotational axis, wherein the width of the interior volume decreases from the outer edge to an opposing portion of the wall along an axis transverse to the rotational axis, wherein an additional width of the outlet between the first housing section and the second housing section decreases from the outer edge to the additional edge along the axis, wherein the centrifugal fan is disposed entirely within the interior volume, wherein at least a portion of the inner circumferential edge is positioned between the outer edge and the additional edge along the axis, and wherein rotation of the fan wheel is configured to direct the airflow through the outlet and across the plurality of tubes of the heat exchanger to place the airflow in thermal communication with the refrigerant.

14. The HVAC system of claim 13, wherein the rotation of the fan wheel is configured to draw the airflow into the interior volume, and wherein the interior volume is configured to facilitate expansion of the airflow as the airflow is directed toward the outlet.

15. The HVAC system of claim 13, wherein the width of the interior volume of the blower housing continuously decreases from the outer edge to the opposing portion of the wall along a portion of a circumference of the wall as the circumference extends toward the opposing portion of the wall.

* * * * *